United States Patent [19]

Guignard et al.

[11] Patent Number: 4,934,618

[45] Date of Patent: Jun. 19, 1990

[54] ROPE COILER

[76] Inventors: Jeannot Guignard, R.R. 1, Boite 11, Site 7; Yvon Noel, R.R. 1, Boite 2, Site 18, both of Petite Lameque, New Brunswick, Canada, E0B 1V0

[21] Appl. No.: 233,413

[22] Filed: Aug. 16, 1988

[30] Foreign Application Priority Data

Apr. 13, 1988 [CA] Canada ..... 564054

[51] Int. Cl.[5] ..... B65H 51/02; B65H 75/22

[52] U.S. Cl. ..... 242/54 R; 242/47; 242/116

[58] Field of Search ..... 242/47, 77, 77.2, 80, 242/85, 86, 104, 106, 115, 116, 129, 54 R

[56] References Cited

U.S. PATENT DOCUMENTS

| | | | |
|---|---|---|---|
| Re. 11,097 | 7/1890 | Ray | 242/115 |
| 293,842 | 2/1884 | Bayles | 242/25 R |
| 482,932 | 9/1892 | Tourangeau | 242/47 |
| 755,212 | 3/1904 | Bradley | 242/106 |
| 1,987,079 | 1/1935 | Rosenmond | 242/25 R |
| 2,225,180 | 12/1940 | Olesen | 242/54 R |
| 2,489,108 | 11/1949 | Schmidt | 242/77.2 |
| 2,562,650 | 7/1951 | Trunkhill | 242/129 |
| 2,602,599 | 7/1952 | Bub et al. | 242/54 R |
| 4,715,554 | 12/1987 | Kuntze | 242/47 |

FOREIGN PATENT DOCUMENTS

| | | | |
|---|---|---|---|
| 2614 | of 1855 | United Kingdom | 242/77 |
| 3059 | of 1874 | United Kingdom | 242/54 R |

*Primary Examiner*—Katherine A. Matecki

*Attorney, Agent, or Firm*—Berman, Aisenberg & Platt

[57] ABSTRACT

There is provided a new and useful rope coiler comprising a support frame, a first support shaft extending substantially vertically from the frame, a spindle rotatable on the first support shaft, a second support shaft spaced from the first shaft and extending substantially horizontally from the frame, and a spool mounted for rotation on the second support shaft, and wherein the spool includes means whereby a coil of rope or wire may be removed therefrom.

15 Claims, 4 Drawing Sheets

ROPE COILER

This application relates to an apparatus for coiling rope.

BACKGROUND OF THE INVENTION

Various commercial undertakings rely on the use of large quantities of rope. In such undertakings it is generally the case that the rope is frequently required to be uncoiled and re-coiled. A number of factors contribute to making the re-coiling of rope a difficult and time consuming task. For example, after use a given rope is normally required to be taken in at a fairly rapid rate, that rate of intake being much quicker than such as would allow proper coiling during intake. In such situations the rope is normally simply taken in to a loose coil which must then be tightly and evenly re-coiled.

Loosely coiled or piled rope presents difficulty of storage, is difficult to move and, very important, is much more likely to tangle when again uncoiled than is a properly coiled rope.

The fishing industry is one example of an area where these problems present themselves.

There is thus a longstanding requirement for a reasonably portable rope coiler by means of which the loose intake coils of lengths of rope can be quickly and properly re-coiled.

It is against this background that the present invention arises.

PRIOR ART

Applicant is generally aware that various reel configurations have been proposed for coiling such elongated configurations as fire and other hoses. Applicant is not, however, aware of any specific prior art directed at rope coilers.

BRIEF SUMMARY OF THE INVENTION

A rope coiler has now been developed which includes a freely rotatable spindle for carrying a loosely coiled rope and a spool or reel for forming a tighter more compact coil.

Accordingly, the invention provides a rope coiler comprising a support frame, a first support shaft extending substantially vertically from the frame, a spindle rotatable on the first support shaft, a second support shaft spaced from the first shaft and extending substantially horizontally from the frame, and a spool mounted for rotation on the second support shaft, and wherein the spool includes means whereby a coil of rope or wire may be removed therefrom.

In the preferred case a device is interposed between the spindle and the spool for lengthening the travel distance between the spindle and the spool to provide an opportunity for examining the rope during the coiling operation.

BRIEF DESCRIPTION OF THE DRAWINGS

These and other objects and advantages of the invention will become apparent upon reading the following detailed description and upon referring to the drawings in which.

Figure 1:
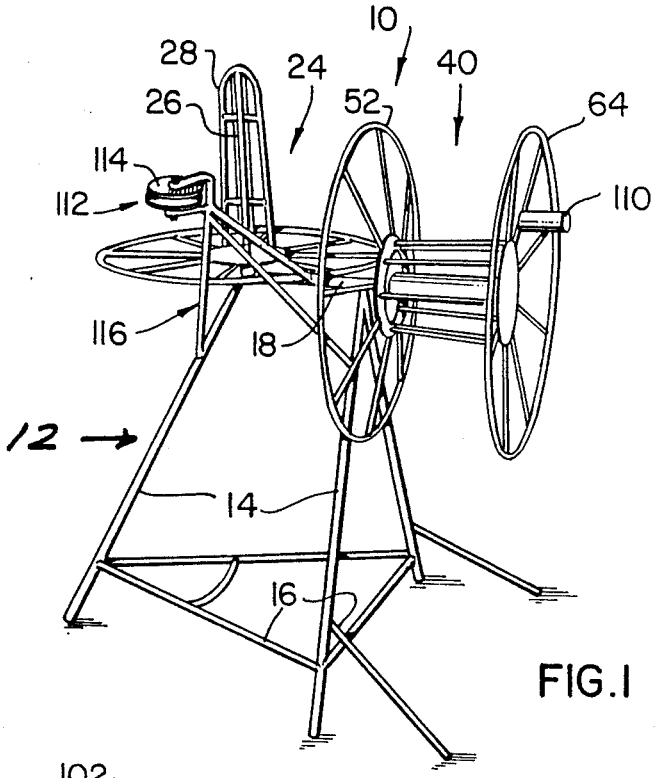
FIG. 1 is a perspective view of a rope coiler in accordance with the invention.
Figure 3:
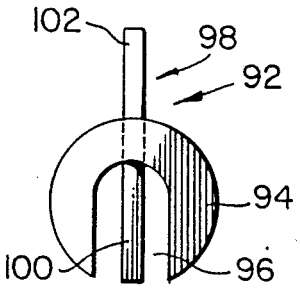
FIGS. 3 and 4 respectively are front and side views of a key lock to secure the spool of the apparatus in FIG. 1 on the horizontal shaft.
Figure 4:
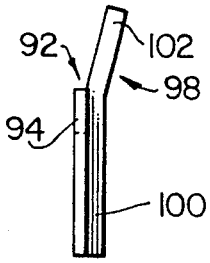
Figure 5:
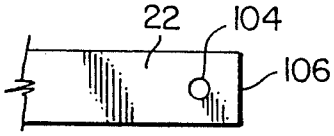
FIGS. 5 and 6 respectively are plan and side views of the end of the horizontal shaft of FIGS. 1 and 2.
Figure 6:
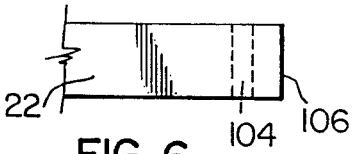

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

The rope coiler 10 is mounted on a support frame 12 which comprises legs 14, lower braces 16 and the upper substantially horizontal member 18.

A pair of shafts 20 and 22 are fixed to the upper member 18. Shaft 20 is of substantially vertical configuration. While the vertical configuration is preferred, some variation from the vertical is permissible without seriously hampering the operation of the invention.

The shaft 22 is generally horizontal. Again, while the horizontal is preferred, considerable variation is permissible within the scope of the invention.

In the preferred configuration the frame 12 is constructed at least in part of steel tubing, and the horizontal shaft 22 is an integral extension of the upper horizontal frame member 18. Clearly other suitable materials of construction may be used as appropriate for various parts of the apparatus.

A spindle 24 is mounted for rotation on the vertical shaft 20. The spindle 24 comprises an elongated central shaft 26, preferably surrounded by a somewhat conically configured framework 28. The shaft 26 and framework 28 are secured on the substantially flat circular base 30. The base 30 preferably comprises a central disc 32 and a spoked circular frame or wheel 34.

The central shaft 26 of spindle 24 is of tubular configuration having an inside diameter greater than the outside diameter of vertical shaft 20, so that the shaft 26 and spindle 24 can simply be slid down onto shaft 20 so that the spindle 24 is freely rotatable on the shaft 20.

The vertical shaft 20 is preferably provided with a stop 36 comprising, for example, a washer, against which the bottom 38 of disc 32 rests.

In an alternative configuration, the vertical shaft 20 may terminate at stop 36, and the central shaft 26 of spindle 24 may have an outside diameter less than the inside diameter of shaft 20. Central shaft 26 may then be extended below central disc 32 and slid into the short shaft 20.

Various other configurations can be devised for the spindle 24 within the scope of the invention. The requirement is basically for a rotating support platform having a raised central structure such that a loose coil of rope can be placed around the central structure on the platform.

Figure 2:
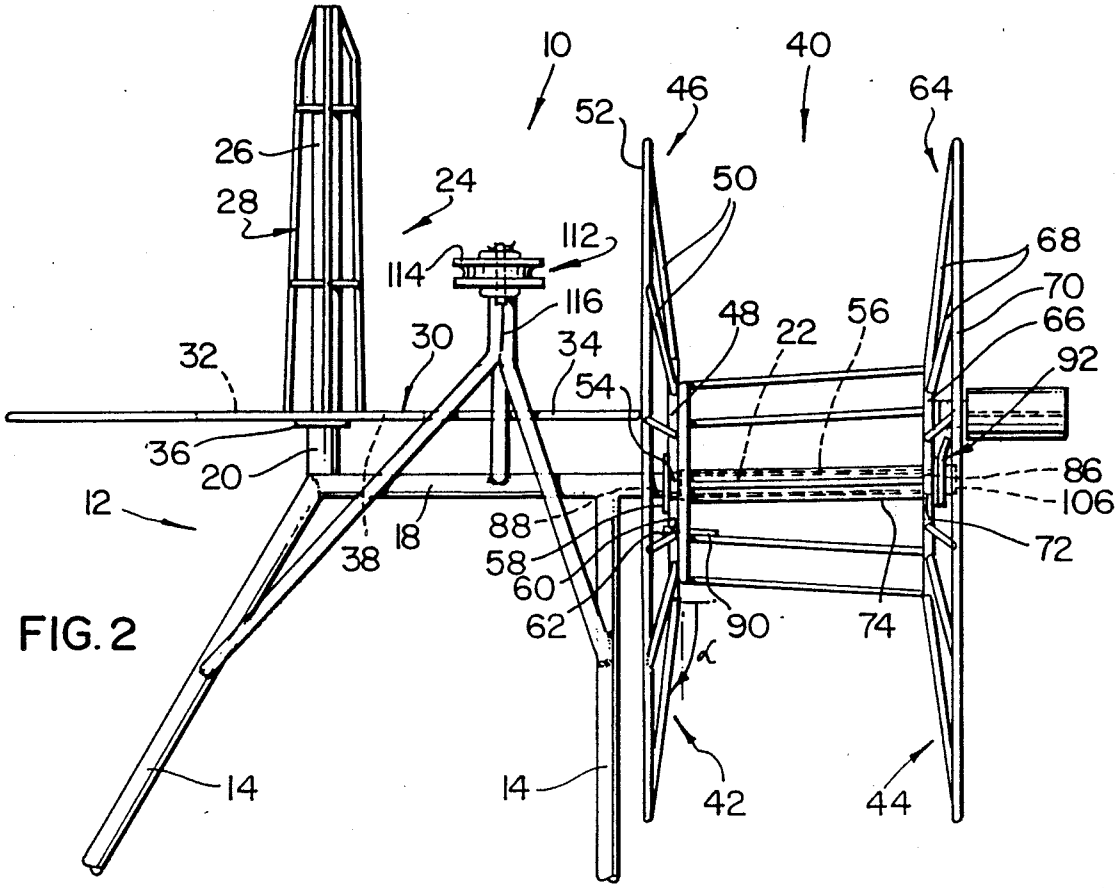
FIG. 2 is a partial side view of the apparatus of FIG. 1.
Figure 7:
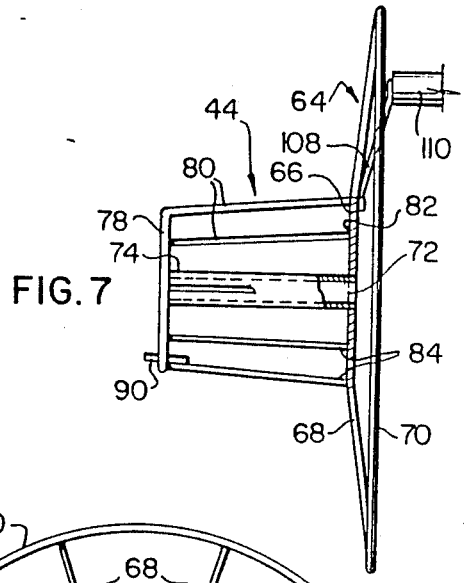
FIG. 7 is a side elevation partially cut away of one end structure of the spool of the apparatus of FIG. 1.
Figure 8:
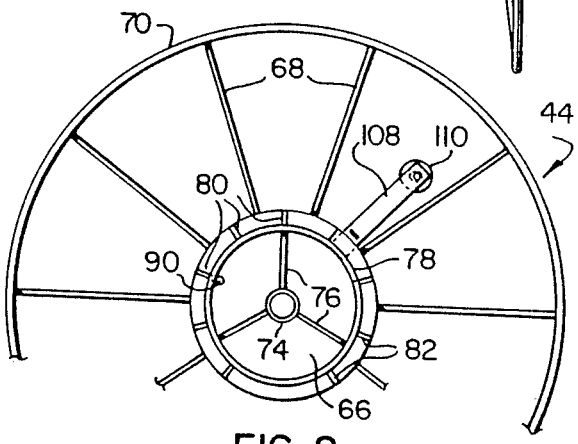
FIG. 8 is an inner end elevation of the end structure of FIG. 7.
Figure 9:
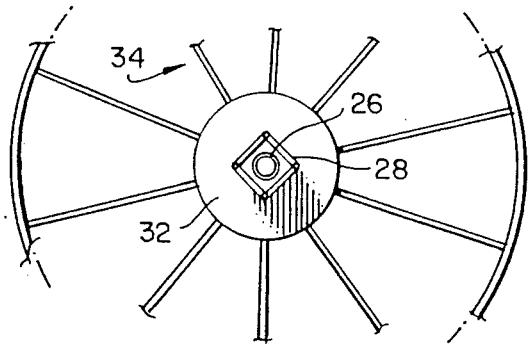
FIG. 9 is a partial plan view of a spindle for use on the coiler of FIG. 1.
Figure 10:
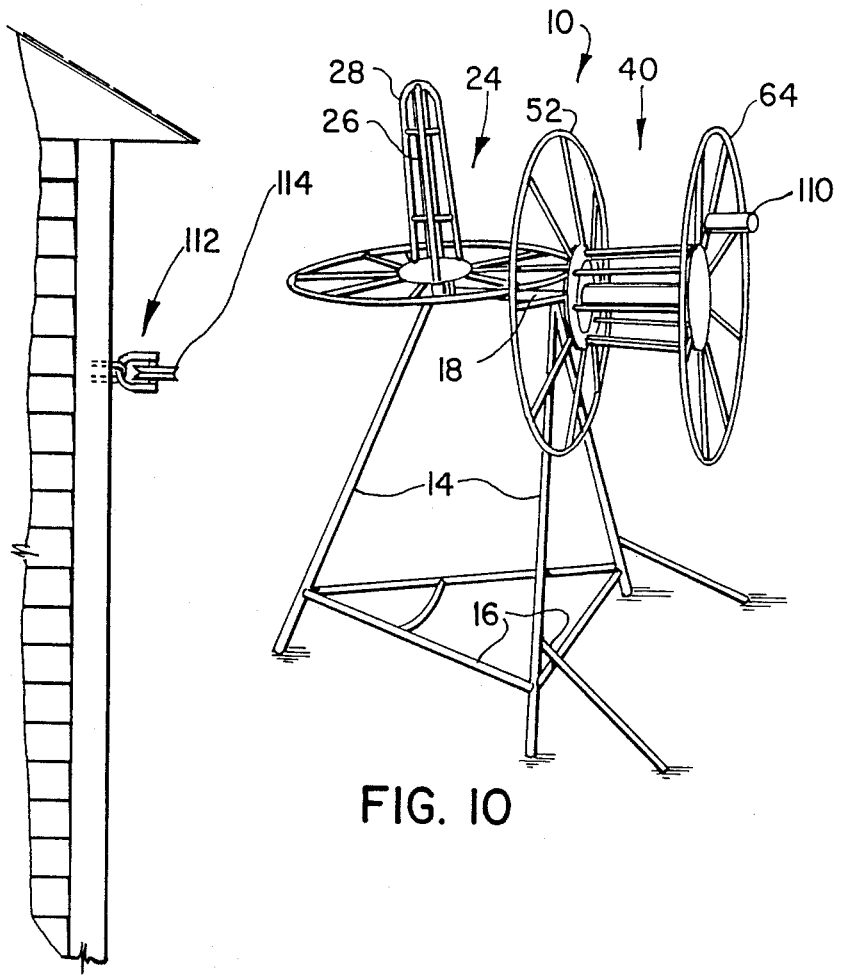

The spool 40 is mounted for rotation on the horizontal shaft 22. Spool 40 is a two part device comprising a first part 42 (see particularly FIG. 2) and a second part 44 (see particularly FIGS. 2 and 7).

The first part 42 includes an end structure 46 comprising a central disc 48 from which emanate a series of spokes 50 to an outer rim 52. The spokes 50 are preferably at an angle $\alpha$ of greater than 90 degrees to the axis of the spool 40 and thus are flared somewhat from disc 48. This specific angle is not of particular importance. The central disc 48 includes a central aperture 54 which is of greater diameter than the outside diameter of horizontal shaft 22. Extending perpendicular to central disc 48 of end structure 46 is a central tubular shaft 56. The inside diameter of shaft 56 is greater than the outside diameter of horizontal shaft 22, whereby the part 42 of spool 40 may be slid onto the horizontal shaft 22. The horizontal shaft 22 includes a stop 58 against which the surface 60 of disc 48 abuts to limit the degree to which the first part 42 of spool 40 may be slid onto shaft 22.

The central disc 48 includes a radially offset aperture 62 for a purpose to be described later.

The second part 44 of spool 40 includes an end structure 64. End structure 64 comprises a central disc 66 from which project a series of radial spokes 68 to an outer rim 70. The spokes 68 are preferably at an angle similar to that of angle $\alpha$ to the axis of spool 40 and thus are flared somewhat from disc 66 in the opposite direction of spokes 50.

The central disc 66 includes a central aperture 72. A hollow shaft 74 projects perpendicular to and centrally of the disc 66. Aperture 72 and shaft 74 have a common axis. From the end of shaft 74 remote from disc 66 a series of radial spokes 76 project to a rim 78. Rim 78 is joined to disc 66 by a series of spokes 80.

The diameter of rim 78 is less than the diameter of a circle passing through the points 82 on disc 66 at which the ends 84 of spokes 80 join disc 66. The cage structure formed by spokes 80 is thus tapered somewhat from disk 66 to rim 78.

The diameter of central aperture 72 of disc 66 is larger than the outside diameter of horizontal shaft 22 but preferably less than the outside diameter of the central shaft 56 extending from central disc 48. At the same time the shaft 74 extending from the central disc 66 has a larger inside diameter than the outside diameter of shaft 56 of central disc 48. The shafts 56 and 74 are substantially the same length.

These dimensions permit the shaft 74 of central disc 66 of the part 44 of spool 40 to be slid over horizontal shaft 22 and over the shaft 56 of disc 44 of first part 42 of spool 40. Since the shafts 56 and 74 are of substantially the same length, the end 86 of shaft 56 will bring up against disc 66 as the end 88 of shaft 74 and rim 78 bring up against disc 48. When the parts are thus brought together, a complete spool is formed.

In order to ensure that the spool 40 rotates on horizontal shaft 22 as a unit, a pin 90 extending outwardly of the rim 78 in the axial direction is secured to one of the spokes 80 in a radial position which will allow it to engage the aperture 62 in disc 48. Rotation of one or other of the parts 42 and 44 will thereby cause the other part to rotate.

In order to maintain the parts 42 and 44 in the proper overlapping position, a key lock 92 is provided to engage shaft 22 to prevent removal of spool 40 from the shaft. The key lock 92 preferably comprises a washer section 94 from which a part has been removed to leave opening 96. The width of opening 96 is just larger than the outside diameter of the horizontal shaft 22. A pin 98 is secured to one side of the washer and has a part 100 extending through the center of the opening 96 in a plane parallel to the plane of the washer. An upper part 102 serves as a convenient gripping means for insertion and removal of the key lock.

An aperture 104 is provided, preferably vertically, through the horizontal shaft 22. In order to lock the spool 40 on the shaft 22, the lower part 100 of the pin 98 is inserted through the aperture 104. Any movement of the spool 40 in a direction toward the outer end 106 will cause the disc 66 to bring up against the washer section 94.

The spool 40 includes means for effecting rotation. As illustrated, that means comprises a crank 108 secured at one end to disc 66 and having a handle 110 secured to its other end. Any similar type of handle means is suitable for causing rotation of spool 40.

As well, a drive spindle (not shown) may be attached to spool 40, preferably to disc 66, whereby means such as an electric motor can be used to drive the spool.

Finally, the coiler includes a spacing device 112 which serves to increase the travel distance between the spindle and the spool in order to provide an opportunity for an operator to examine the condition of the rope during the coiling operation. The device 112 may incidentally add tension in the rope to ensure a reasonably tight coil on the spool 40. At the same time, the device may be so positioned as to provide a proper angle of approach of the rope to the spool.

In its illustrated configuration, the device 112 comprises a pulley 114 mounted on a support member 116. In its most preferred format the spacing device 112 is secured to support means separate from the structure 10. For example, in the case of use in the fishing industry, the pulley could be mounted to the wall of a convenient dockside shed. Typically the device 112 would be located about 10 feet from the remainder of the apparatus.

In use a loose coil of rope is placed over the frame work 28 onto base 30 of spindle 24. The end of the rope is led by way of the tensioning means 112 to the spool 40. The end of the rope may be secured to the spool 40 in any convenient manner that will allow subsequent removal as, for example, by tying with lighter rope or twine. The spool is then rotated to take up the rope into a tighter more compact coil. Once the entire length of rope has been coiled, the key lock 92 is removed and the part 44 of spool 40 removed from shaft 22. The tapering cage formed by the spokes 80 then permits the coil to readily be slid off of part 44. The coil is normally tied with twine to maintain its integrity.

While the expression "rope" has been utilized throughout this disclosure, it is intended that that term include any rope, cable, wire rope or the like line, whether of natural or synthetic fibres or any combination thereof.

Thus it is apparent that there has been provided in accordance with the invention a rope coiler that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What we claim as our invention:

1. A rope or cable coiler comprising:

a support frame;

a first support shaft extending substantially vertically from said frame;

a spindle rotatable on said first support shaft and comprising a substantially horizontally disposed base member and an elongated central member extending substantially vertically from said member for supporting a loose coil of said rope or cable;

a second support shaft spaced from said first shaft and extending substantially horizontally from said frame;

a spool mounted for rotation on said second support shaft for receiving said rope or cable from said spindle; and spacing means fixedly mounted with respect to said frame during use for guiding said rope or cable along a path from a first location on said spindle to a second location intermediate said spool and said spindle and then to a third location on said spool, said second location being offset substantially from a line joining said first and third locations, whereby the path of said rope or cable is substantially longer than the spacing between said first and third locations;

wherein said spool includes disassembly means for permitting a coil of rope or cable to be removed therefrom.

2. The coiler of claim 1 wherein said spool is provided with a crank handle for rotating said spool.

3. The coiler of claim 1 wherein said spacing means comprises a pulley.

4. The coiler of claim 3 wherein said spacing means is mounted on a support member extending from said frame.

5. The coiler of claim 3 wherein said spacing means includes support means independent of said frame.

6. The coiler of claim 1 wherein said central member includes a hollow cylindrical core adapted to be mounted on said first shaft.

7. The coiler of claim 6 wherein said base member comprises a spoked wheel.

8. The coiler of claim 1 wherein said disassembly means comprises means for separating said spool into first and second parts.

9. The coiler of claim 8 wherein said spool first part comprises a first substantially flat base frame and a first central cylindrical shaft extending perpendicular therefrom; and said spool second part comprises a second substantially flat base frame and a second central cylindrical shaft extending perpendicular therefrom; and wherein the outside diameter of said first central shaft is less than the inside diameter of said second central shaft, whereby said second central shaft may be slid onto said first central shaft.

10. The coiler of claim 9 wherein said central shafts are of approximately equal length and wherein said spool second part includes a support frame of truncated conical configuration surround said second central shaft and having an outer end, and approximately equal in length to said second central shaft, whereby, when said second central shaft is slid over said first central shaft, said outer end of said truncated conical support frame lies adjacent said first base frame.

11. The coiler of claim 10 further comprising means for interconnecting said truncated conical support frame and said first base frame when said second central shaft is slid over said first central shaft to thereby prevent relative rotation between said conical support frame and said first base frame.

12. The coiler of claim 11 wherein said interconnecting means comprises a pin in one of said truncated conical support frame and said first base frame which fits into an opening in the other of said truncated conical support frame and said first base frame.

13. The coiler of claim 9 wherein said second support shaft includes an opening to receive a locking key whereby to lock said spool on said second support shaft.

14. A rope or cable coiler comprising:

a support frame;

a first support shaft extending substantially vertically from said frame;

a spindle rotatable on said first support shaft and comprising a substantially horizontal base part and a vertically extending central projection;

a second support shaft spaced form said first shaft and extending substantially horizontally from said frame;

a spool mounted for rotation on said second support shaft; said spool comprising first and second parts which are separable from each other whereby a coil of rope or cable may be removed therefrom; said spool comprising a first end piece comprising a first substantially flat base frame and a first central cylindrical shaft extending perpendicular therefrom and secured on said second support; a second end piece comprising a second substantially flat base frame and a second central cylindrical shaft extending perpendicular therefrom; wherein the outside diameter of said first central shaft is less than the inside diameter of said second central shaft, whereby said second central shaft is removable secured on said first central shaft; and wherein said central shafts are of approximately equal length and wherein said second end piece includes extending perpendicular to the surface thereof around said second central shaft a support frame of truncated conical configuration having an outer end, and approximately equal in length to said second central shaft, whereby, when said second central shaft is slid over said first central shaft, said outer end of said truncated conical support frame lies adjacent said first base frame.

15. The coiler of claim 14 further comprising means for interconnecting said conical support frame and said first base frame when said second central shaft is slid over said first central shaft to thereby prevent relative rotation between said conical support frame and said first base frame.

* * * * *